US005595476A

United States Patent [19]

Abel et al.

[11] Patent Number: 5,595,476

[45] Date of Patent: Jan. 21, 1997

[54] PUMP SHAFT DRIVEN INLET AND OUTLET RADIAL PIN ARRANGEMENT FOR REDUCING FLUID RIPPLE

[75] Inventors: Steve Abel; Gordon Whelpley, both of Chandler, Ariz.

[73] Assignee: AlliedSignal Inc., Morris Township, N.J.

[21] Appl. No.: 605,930

[22] Filed: Feb. 23, 1996

[51] Int. Cl.[6] ..... F04B 11/00; F04B 1/20

[52] U.S. Cl. ..... 417/53; 417/312; 417/540; 417/542

[58] Field of Search ..... 417/53, 244, 254, 417/312, 540, 542

[56] References Cited

U.S. PATENT DOCUMENTS

| | | | |
|---|---|---|---|
| 1,790,922 | 2/1931 | Hobart . | |
| 1,893,685 | 1/1933 | Pirsch . | |
| 2,474,553 | 6/1949 | Stephens . | |
| 2,811,931 | 11/1957 | Everett | 417/265 |
| 3,726,613 | 4/1973 | Von Casimir | 417/477 |
| 3,826,593 | 7/1974 | Von Casimir | 417/53 |
| 4,486,160 | 12/1984 | Lipscombe | 418/205 |
| 4,734,011 | 3/1988 | Hall, Jr. | 417/540 |
| 4,907,408 | 3/1990 | Barker . | |
| 4,934,251 | 6/1990 | Barker . | |
| 5,102,311 | 4/1992 | Lambeck | 417/540 |
| 5,219,000 | 6/1993 | Chalasani et al. . | |
| 5,257,606 | 11/1993 | Willman et al. . | |
| 5,492,451 | 2/1996 | Franz et al. . | |

FOREIGN PATENT DOCUMENTS

| | | | |
|---|---|---|---|
| 4255576 | 9/1992 | Japan | 417/540 |

OTHER PUBLICATIONS

"The Reduction of Gear Pump Pressure Ripple", Edge, et al., *Proc Instnt Mech Engrs,* vol. 201, No. B2, pp 99–106.

*Primary Examiner*—Timothy Thorpe
*Assistant Examiner*—Roland G. McAndrews, Jr.
*Attorney, Agent, or Firm*—Jerry J. Holden; John R. Rafter

[57] ABSTRACT

An apparatus for reducing ripple in the flow of a fluid through a positive displacement pump comprises an inlet tube in fluid communication with an inlet of the pump and an outlet tube in fluid communication with an outlet of the pump. A first annulus is in fluid communication with the inlet tube and a second annulus is in fluid communication with the outlet tube. A drive shaft is connected to a main drive shaft of the pump and first and second cams are connected to the drive shaft. The first cam is associated with the first annulus and the second cam is associated with the second annulus. A plurality of pins are provided and each has a portion located within one of the annuluses and an end opposite that portion in contact with the cam associated with the respective annulus. During operation of the pump, the drive shaft rotates the cams thereby driving the pins up and down within the annulus and thereby creating a ripple within the fluid contained within the annuluses and thereby within the inlet and outlet of the pump, thereby effectively canceling or substantially offsetting the pressure ripple created by the action of the pump.

8 Claims, 2 Drawing Sheets

PUMP SHAFT DRIVEN INLET AND OUTLET RADIAL PIN ARRANGEMENT FOR REDUCING FLUID RIPPLE

TECHNICAL FIELD

This invention relates to the reduction of ripple or fluctuations within the flow of a fluid through a pump or motor and more particularly, to the cancellation of ripple within the flow of fluid through an axial piston fixed positive displacement pump.

BACKGROUND OF THE INVENTION

The use of positive displacement hydraulic pumps and motors is well known in the art. When utilizing such a pump, fluctuations within the flow of fluid are created by the reciprocating action of the piston exposed to the suction and the discharge of the pump. These fluctuations of flow are referred to as ripple, thereby producing uneven flow plenums of the fluid.

The primary problem associated with the pressure ripples in such a hydraulic system is noise. The intake and delivery of fluid by positive displacement pumps is unsteady and exhibits fluctuations dependent upon the mechanism of fluid transfer and the number of pumping elements. These periodic flow fluctuations produce pressure fluctuations in the fluid, termed fluid-borne noise, that are transmitted via the fluid throughout the hydraulic system causing structural vibration and air-borne noise. Besides making a significant contribution to the system air-borne noise, high levels of fluid-borne noise can also cause a significant reduction in the life of individual hydraulic components. In fact, it has been predicted that pump life might be reduced by a factor up to three due to the additional effects of fluid-borne noise.

Attempts to reduce the contribution made by the pump to overall noise levels have shown that whereas a high degree of structural isolation may be obtained by flexible mounting of the pump, the isolation of pump pressure ripple is more difficult to achieve.

Previous attempts to reduce the pressure ripple have fallen short. One such attempt utilizes a single cam and piston set that is in fluid communication with both the outlet port and the inlet port of the pump. The drive shaft of the pump rotates the cam thereby driving the pistons to create a fluctuation in the fluid that ideally reduces or offsets the pressure fluctuations created by the pump. This has been found to be restrictive in that the inlet and outlet of the pump have different pressure signatures and would therefore ideally require different ripple compensation profiles. With legislation, in the form of the Health and Safety at Work Act of 1974, Congress has set maximum levels of noise to which an operator in an industrial environment may be subjected. This leads to a serious need for proper and economical noise reduction techniques in an industrial environment. Additionally, military objectives can lead to the need for significant noise reduction within engine and hydraulic systems, since noise is an ideal manner in which an adversary can track and monitor military vehicles such as submarines.

Accordingly, a method and apparatus is needed that overcomes the shortcomings of the prior art by providing a consistent and optimum reduction or cancellation of pressure ripples within the flow of fluid through positive displacement pumps and motors.

SUMMARY OF THE INVENTION

A method and apparatus for reducing pressure ripples within the flow of fluid through a positive displacement pump or motor according to the present invention addresses the shortcomings of the prior art.

In accordance with one aspect of the present invention, an apparatus for reducing ripple in the flow of a fluid through a positive displacement pump comprises an inlet tube in fluid communication with an inlet of the pump and an outlet tube in fluid communication with an outlet of the pump. A first annulus is in fluid communication with the inlet tube and a second annulus is in fluid communication with the outlet tube. A drive shaft is connected to a main drive shaft of the pump and first and second cams are connected to the drive shaft. The first cam is associated with the first annulus and the second cam is associated with the second annulus. A plurality of pins are provided and each has a portion located within one of the annuluses and an end opposite that portion in contact with the cam associated with the respective annulus. In a preferred embodiment, the cams are profiled and docked in such a manner so as to offset the displacement irregularities of the main pump. During operation of the pump, the drive shaft rotates the cams thereby driving the pins up and down within the annulus and accordingly creating a ripple within the fluid contained within the annuluses and within the inlet and outlet of the pump, thereby effectively canceling or substantially reducing the pressure ripple created by the action of the pump.

In accordance with a further aspect of the apparatus, at least one, and preferably both of the cams' clocking is adjusted relative to a rotor of the pump, thereby optimizing the ripple cancellation effects of the apparatus.

BRIEF DESCRIPTION OF THE DRAWINGS

The present invention will hereinafter be described in conjunction with the appended drawing figures, wherein like designations denote like elements, and.

DETAILED DESCRIPTION OF THE PREFERRED EMBODIMENT

Figure 1:
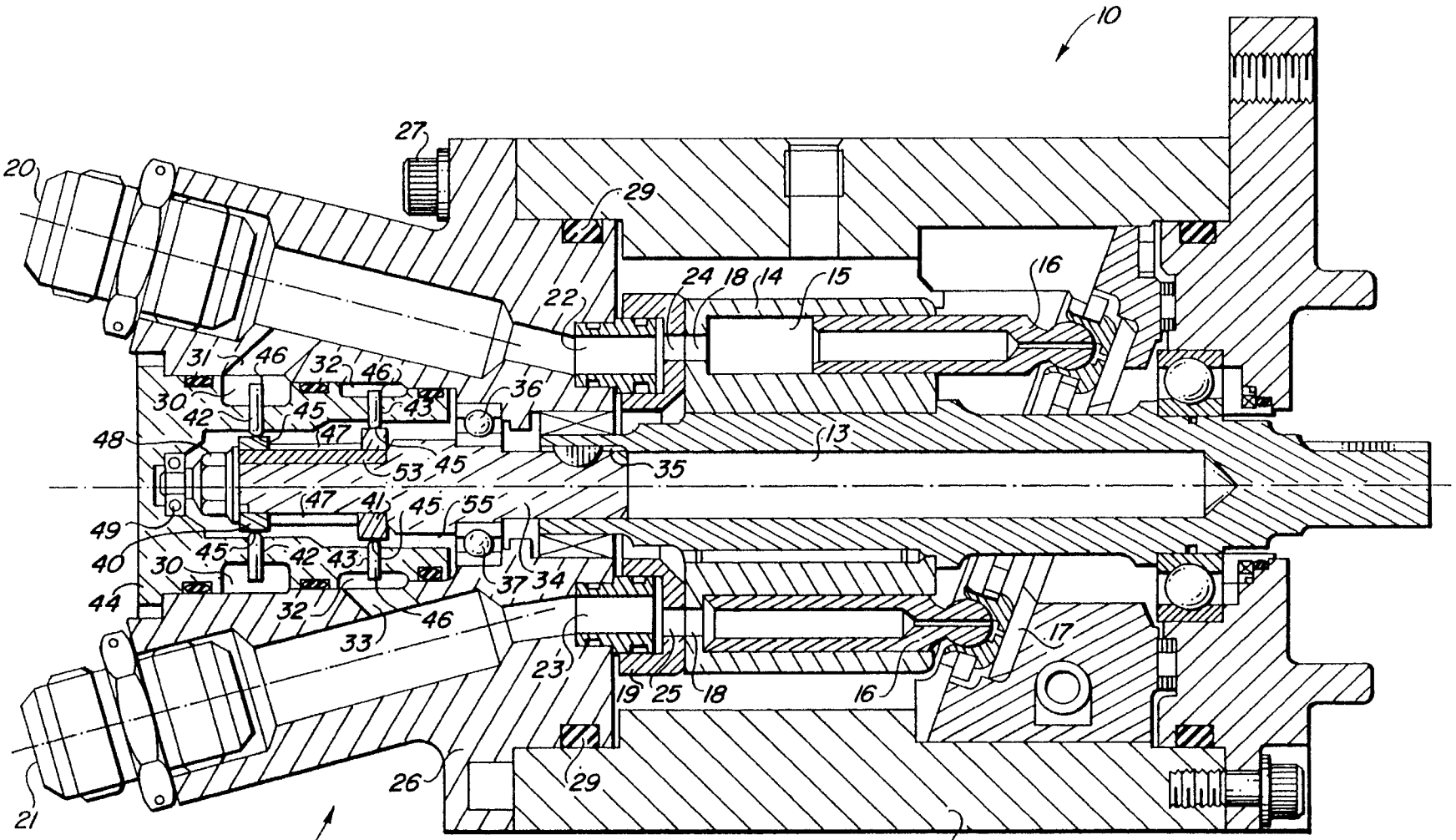
FIG. 1 is a plan view of an axial piston fixed positive displacement pump with the ripple cancellation apparatus attached thereto and constructed in accordance with a preferred embodiment of this invention.

FIG. 1 illustrates an axial piston fixed positive displacement pump 10 with a ripple cancellation apparatus 11 attached thereto. The pump 10 is a high speed, fixed displacement, rotating cylinder block,type piston pump that is well known in the art. The pump 10 is comprised of a housing 12 having a shaft 13 rotatably mounted therein. One end of the shaft 13 is coupled to an output shaft of a rotational power source such as a pneumatic motor (not shown). The other end of the shaft 13 has a cylinder block or rotor 14 having a circular array of axial pumping chambers 15 for slidably receiving pistons 16. Only two of these chambers and pistons are shown in FIG. 1. The head of each piston 16 rides on a cam plate 17 which causes the pistons 16 to reciprocate within the chambers 15 in response to the rotation of the shaft 13. The bottom of each of the chambers 15 opens into conduits 18 through which hydraulic fluid flows.

Ripple cancellation apparatus 11 comprises a suction/inlet 20 and a discharge/outlet 21. Inlet 20 and outlet 21 are in fluid communication with transfer tubes or balance pistons 22, 23 respectively. The transfer tubes are likewise in fluid communication with an inlet 24 and an outlet 25, respectively, of pump 10. Housing 26 encases apparatus 11 and has bolts 27 (only one of which is shown) for attaching apparatus 11 to pump 10. Four springs (not shown) are provided between floating port plates 19 and housing 26 in order to help keep apparatus 11 and pump 10 pressed tightly. An O-ring 29 is utilized to provide a seal between housing 26 and pump 10.

Annulus 30 is in fluid communication with inlet 20 via a single passageway 31. Likewise, annulus 32 is in fluid communication with outlet 21 via passageway 33. A drive shaft 34 is provided in the center of apparatus 11 and is connected to main shaft 13 of pump 10 with a spline connection 35. Ball bearings 36, 37 are interposed between spline connection 35 and housing 26.

Connected to drive shaft 34 are cams 40, 41. Each cam has associated therewith a plurality of pins 42, 43, respectively. The pins project through an associated one of a plurality of holes that are defined within a sleeve or collar 44. Each of the pins has an end 45 that is in contact with its respective cam and an opposite end 46 that projects through sleeve 44 into the annulus that the cam and its respective pins are associated with. The cams are spaced apart by a cylindrical spacer 47. A clamping nut 48 is utilized to secure drive shaft 34 to main shaft 13. An end of drive shaft 34 is contained within sleeve 44 and has a needle bearing 49 mounted thereto to allow for rotation of drive shaft 34.

Figure 2:
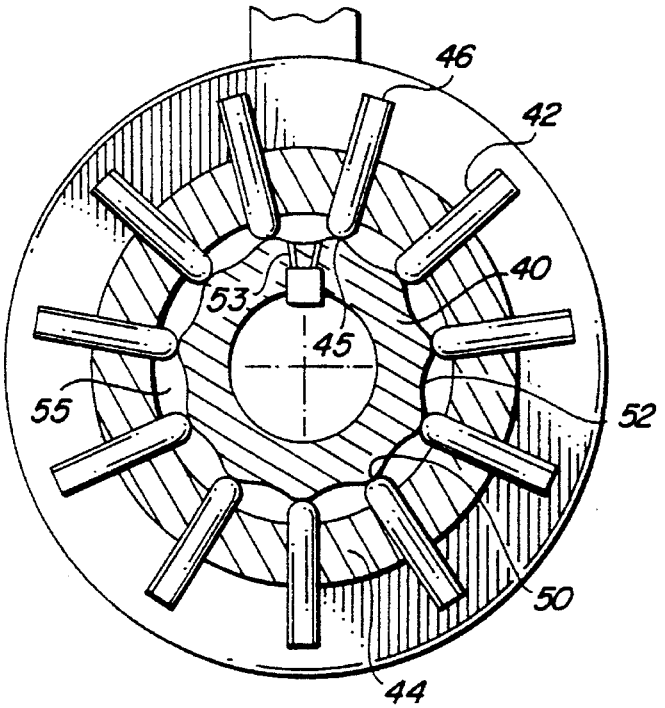
FIG. 2 is a plan view of a cam and pin arrangement for the ripple cancellation apparatus at a suction portion of the apparatus and constructed in accordance with a preferred embodiment of this invention; and, FIG. 3 is a perspective view of a cam and pin arrangement for a discharge portion of the ripple cancellation apparatus and constructed in accordance with a preferred embodiment of this invention.

Turning now to FIG. 2, the cam associated with the inlet of the apparatus is illustrated. There are 11 lobes 50 on cam 40 that are equally spaced. From a manufacturing standpoint, this allows cam 40 to be more easily manufactured, but of course the lobes need not be evenly spaced if this will contribute to optimizing cancellation of ripple within the pump. Additionally, the clocking of the cam can be adjusted if this leads to better performance of the apparatus. The clocking can be adjusted such that cam 40 is offset in alignment relative to alignment of rotor 14. Load balance and minimization can also be achieved by adjusting the clocking.

The size of cam 40, i.e. , diameter, is determined through measurement of flow through inlet 20 and ripple created by pump 10, which is then analyzed with a computer program in order to determine an amount of ripple that should be created by operation of cam 40 to cancel or offset the amount of ripple created by the pump. The computer program calculates the radius of the cam to lobes 50 and the radius of the cam to gaps 52 between lobes 51. The values will vary depending on the size and type of pump 10 that is being utilized. The computer program is well known to anyone skilled in the art.

Figure 3:
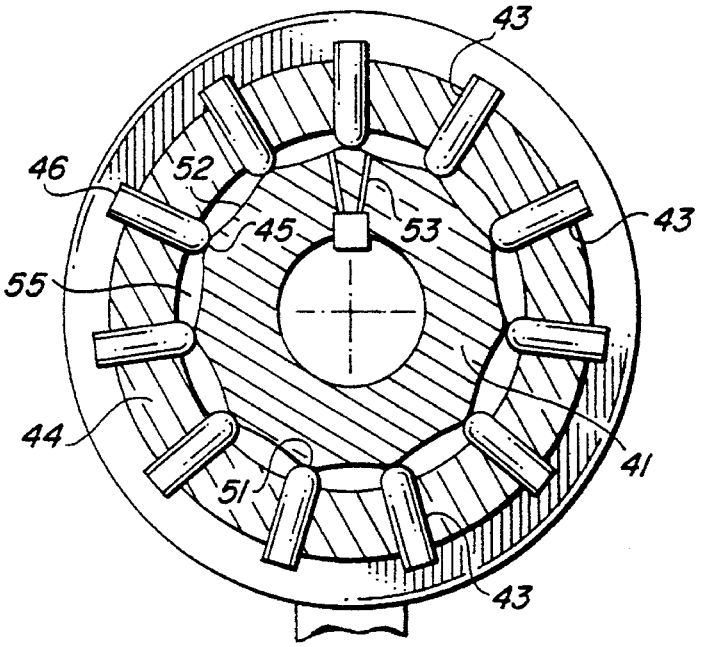

With reference to FIG. 3, cam 41, which is associated with outlet 21 is illustrated. As with cam 40, there are 11 lobes 51 that are evenly spaced about the periphery of cam 41. Once again, the even spacing of lobes 51 is not a requirement if it is determined that this would optimize cancellation of ripple. Additionally, the docking of cam 41 can be adjusted. The size of cam 41 is calculated with the same computer program utilized for cam 40.

A key 53 keeps cams 40, 41 in place on drive shaft 34, but can be removed to adjust the clocking.

Recess 55 allows for case drain fluid to provide lubrication during operation.

In operation, drive shaft 32 is rotated by main shalt 13 of the pump and thereby rotates cams 40, 41. This drives pins 42, 43 in an "up and down" or reciprocating fashion within their respective annuluses. The reciprocating motion of the pins within the annuluses creates ripple within the annuluses and the passageways, and thereby the inlet and outlet. This created ripple then cancels or substantially offsets the ripple created by the action of pump 10 to provide a smooth flow of fluid throughout the pump and thereby reduce noise.

It will be understood that the foregoing description is that of the preferred exemplary embodiment of the invention, and that the invention is not limited to the specific forms shown and described. Various modifications may be made in the design and arrangement of the elements set forth herein without departing from the scope of the invention as expressed in the appended claims.

We claim:

1. Apparatus for reducing ripple in the flow of a fluid through an axial piston fixed positive displacement pump, said apparatus comprising:

a. an inlet tube in fluid communication with an inlet of said pump;

b. an outlet tube in fluid communication with an outlet of said pump;

c. first annulus in fluid communication with said inlet;

d. second annulus in fluid communication with said outlet;

e. drive shalt connected to a main shaft of said pump;

f. first and second cams connected to said drive shalt, said first cam being associated with said first annulus and said second cam being associated with said second annulus; and, g. a plurality of pins having a portion located within one of said annuluses and an end opposite said portion in contact with the cam associated with the respective annulus;

wherein, said drive shaft is rotated by said main shaft and thereby rotates said cams to cause said pins to reciprocate and create ripple within their respective annuluses and thereby within said inlet tube and said outlet tube to substantially offset ripple within fluid flow created by said pump.

2. The apparatus of claim 1 wherein there are eleven pins associated with said first annulus and said first cam, and there are eleven pins associated with said second annulus and said second cam.

3. The apparatus of claim 2 wherein said first and second cams each have eleven lobes that are not evenly spaced about the periphery of said cams.

4. The apparatus of claim 1 wherein one of said cams clocking is adjusted relative to a rotor of said pump.

5. The apparatus of claim 4 wherein both of said cams clocking is adjusted relative to said rotor.

6. The apparatus of claim 5 wherein there are eleven pins associated with said first annulus and said first cam, and there are eleven pins associated with said second annulus and said second cam.

7. The apparatus of claim 6 wherein said first and second cams each have eleven lobes that are not evenly spaced about the periphery of said cams.

8. A method of reducing ripple in the flow of a fluid through an axial piston fixed positive displacement pump, said method comprising:

a. rotating a first cam that is in contact with a plurality of pins thereby causing said pins to move up and down and create a ripple in the flow of fluid within an inlet tube that is in fluid communication with an inlet of said pump; and, b. rotating a second cam that is in contact with a plurality of pins thereby causing said pins to move up and down and create a ripple in the flow of fluid within an outlet tube that is in fluid communication with an outlet of said pump;

whereby, said ripple created by said pins substantially offsets ripple created by said pump.

* * * * *

UNITED STATES PATENT AND TRADEMARK OFFICE

CERTIFICATE OF CORRECTION

PATENT NO. : 5,595,476

DATED : January 21, 1997

INVENTOR(S) : Abel, et al.

It is certified that error appears in the above-identified patent and that said Letters Patent is hereby corrected as shown below:

Col 4, line 25, insert --a-- before "first";
Col 4, line 26, insert --a-- before "second";
Col 4, line 28, insert --a-- before "drive";
Col 4, line 29, delete "shalt", insert --shaft--.

Signed and Sealed this

First Day of July, 1997

Bruce Lehman

*Attest:*

BRUCE LEHMAN

*Attesting Officer*

*Commissioner of Patents and Trademarks*